US012716165B2

(12) United States Patent
Murphy

(10) Patent No.: US 12,716,165 B2
(45) Date of Patent: Aug. 25, 2026

(54) LAUNDRY APPLIANCE

(71) Applicant: WHIRLPOOL CORPORATION, Benton Harbor, MI (US)

(72) Inventor: Sayer James Murphy, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 960 days.

(21) Appl. No.: 17/811,718

(22) Filed: Jul. 11, 2022

(65) Prior Publication Data

US 2023/0027381 A1 Jan. 26, 2023

Related U.S. Application Data

(60) Provisional application No. 63/221,230, filed on Jul. 13, 2021.

(51) Int. Cl.
*D06F 58/22* (2006.01)

(52) U.S. Cl.
CPC ..... *D06F 58/22* (2013.01)

(58) Field of Classification Search
CPC ..... D06F 58/22
See application file for complete search history.

(56) References Cited

U.S. PATENT DOCUMENTS

| | | | | |
|---|---|---|---|---|
| 9,217,220 | B2 * | 12/2015 | Ahn | D06F 58/22 |
| 2009/0136626 | A1 | 5/2009 | Mueller | |
| 2014/0245562 | A1 * | 9/2014 | Conrad | A47L 9/2878 15/323 |
| 2019/0143154 | A1 | 5/2019 | Gangadhar et al. | |
| 2019/0351459 | A1 | 11/2019 | Dal Molin et al. | |
| 2020/0340170 | A1 | 10/2020 | MacDonald, III et al. | |

FOREIGN PATENT DOCUMENTS

| | | | |
|---|---|---|---|
| CN | 110409154 | A | 11/2019 |
| CN | 211772213 | U | 10/2020 |
| DE | 102015110215 | A1 | 12/2016 |
| EP | 2273005 | A2 | 1/2011 |
| EP | 3090094 | | 7/2015 |
| EP | 3234255 | A0 | 6/2016 |
| EP | 3562987 | A0 | 7/2018 |
| EP | 3562989 | A0 | 7/2018 |
| WO | 2016034302 | A1 | 3/2016 |

OTHER PUBLICATIONS

Commonly assigned co-pending U.S. Appl. No. 17/342,656, filed Jun. 9, 2021, including filing receipt, application and drawings.

* cited by examiner

*Primary Examiner* — Connor J Tremarche
(74) *Attorney, Agent, or Firm* — Price Heneveld LLP

(57) ABSTRACT

A laundry appliance includes a cabinet that defines an opening, a drum accessible via the opening and configured for processing laundry, a blower that conveys process air along an airflow path, and a vortex lint filter coupled to the cabinet and at least selectively disposed within the airflow path. The vortex lint filter has a receptacle that includes an outer side wall that defines an inlet, a floor that extends inboard from the outer side wall, and a tower that extends upward from the floor and defines an outlet. The blower is configured to deliver process air into the receptacle via the inlet, along the outer side wall to create a process air vortex, and out of the receptacle via the outlet, such that particulate matter is separated from the process air and collects within the receptacle.

20 Claims, 6 Drawing Sheets

LAUNDRY APPLIANCE

CROSS-REFERENCE TO RELATED APPLICATIONS

The present application claims priority to U.S. Provisional Patent Application No. 63/221,230, filed Jul. 13, 2021, entitled LAUNDRY APPLIANCE, the entire disclosure of which is hereby incorporated herein by reference.

BACKGROUND OF THE DISCLOSURE

The present disclosure generally relates to a laundry appliance and, more specifically, to a laundry appliance that includes at least one of a disposable lint filter and a vortex lint filter.

SUMMARY OF THE DISCLOSURE

According to one aspect of the present disclosure, a laundry appliance includes a cabinet that defines an opening, a drum accessible via the opening and configured for processing laundry, a blower that conveys process air along an airflow path, and a vortex lint filter coupled to the cabinet and at least selectively disposed within the airflow path. The vortex lint filter has a receptacle that includes an outer side wall that defines an inlet, a floor that extends inboard from the outer side wall, and a tower that extends upward from the floor and defines an outlet. The blower is configured to deliver process air into the receptacle via the inlet, along the outer side wall to create a process air vortex, and out of the receptacle via the outlet, such that particulate matter is separated from the process air and collects within the receptacle.

According to another aspect of the present disclosure, a laundry appliance includes a cabinet that defines an opening, a drum accessible via the opening and configured for processing laundry, a blower that conveys process air along an airflow path, and a vortex lint filter operable between a lint-collection position and a maintenance position. In the lint-collection position, the vortex lint filter is in the airflow path such that a process air vortex occurs within a receptacle of the vortex lint filter and particulate matter is separated from the process air for collection within the receptacle. In the maintenance position, the vortex lint filter is removed from the airflow path.

According to yet another aspect of the present disclosure, a laundry appliance includes a cabinet that defines an opening, a drum accessible via the opening and configured for processing laundry, a blower that conveys process air along an airflow path, and a disposable lint filter removably coupled to the cabinet and disposed within the airflow path. The disposable lint filter has a mouth and a drawstring configured to be pulled to narrow the mouth. The blower is configured to deliver process air into the mouth and through the disposable lint filter, such that particulate matter is separated from the process air by the disposable lint filter.

These and other features, advantages, and objects of the present disclosure will be further understood and appreciated by those skilled in the art by reference to the following specification, claims, and appended drawings.

Figure 1:
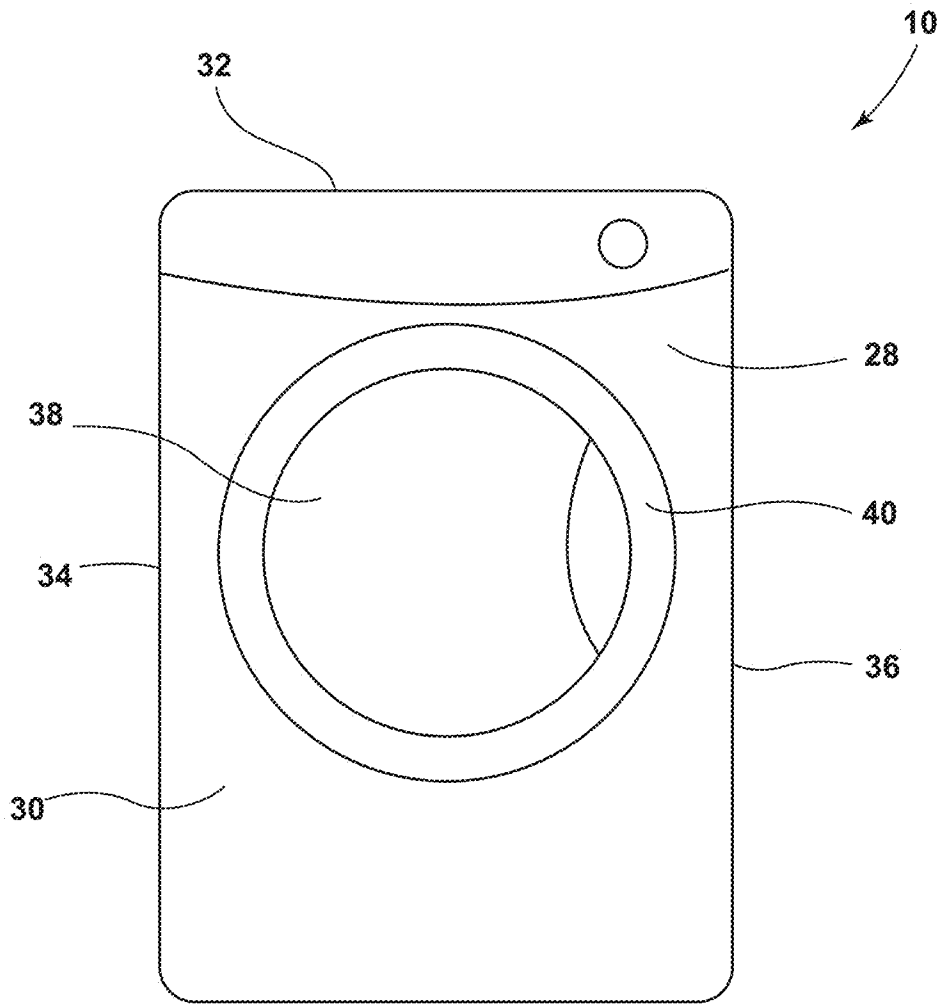
FIG. 1 is a front elevational view of a laundry appliance.

The components in the figures are not necessarily to scale, emphasis instead being placed upon illustrating the principles described herein.

DETAILED DESCRIPTION

The present illustrated embodiments reside primarily in combinations of method steps and apparatus components related to a laundry appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-6, reference numeral 10 generally designates a laundry appliance. The laundry appliance 10 can include various mechanisms for washing, drying, or otherwise processing laundry. Typically, the laundry appliance 10 includes a drum 12 that is configured to rotate to process laundry within the drum 12. A blower 14 is disposed within the laundry appliance 10 and delivers process air 16 through an airflow path 18 of the laundry appliance 10. The blower 14 can be a fan, an air-handling unit, or other air-moving device that can move process air 16 through the drum 12 using positive pressure or negative pressure via an induced flow of process air 16 through the drum 12. The airflow path 18 can include various air-conditioning mechanisms 20. These air-conditioning mechanisms 20 can include one or more heat exchangers, electrical heaters, and other similar mechanisms that serve to heat and, in certain applications, cool the process air 16 within the laundry appliance 10. At least one of a disposable lint filter 22 and a vortex lint filter 24 is positioned within the airflow path 18 and is configured to filter particulate matter 26, such as lint particles, from the process air 16.

Figure 5:
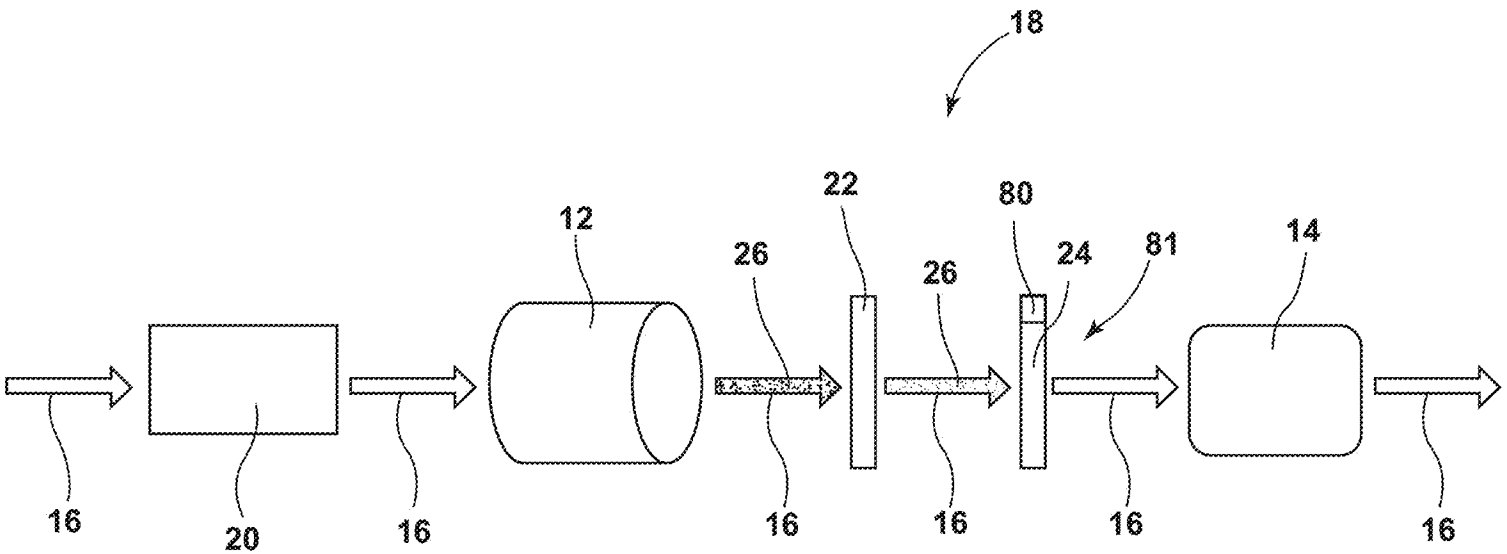
FIG. 5 is a schematic diagram of an airflow path for a laundry appliance including a disposable lint filter and a vortex lint filter.
Figure 6:
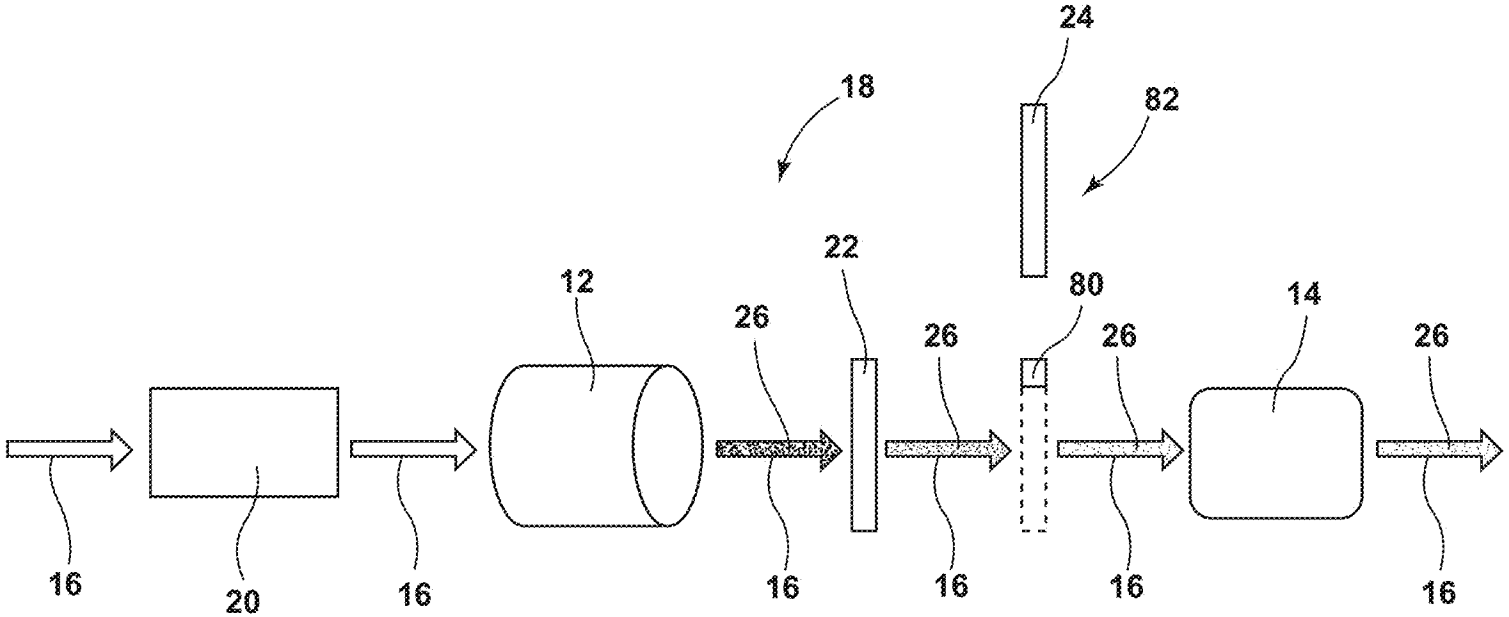
FIG. 6 is a schematic diagram of an airflow path for a laundry appliance including a disposable lint filter and illustrating a vortex lint filter removed from the airflow path in a maintenance position.

In the embodiment illustrated in FIG. 5, process air 16 entering the airflow path 18 is initially drawn past the air-conditioning mechanism 20 that heats the process air 16. Next, the process air 16 is delivered to the drum 12. The combination of the process air 16 and particulate matter 26 from within the drum 12 flows out of the drum 12 and through the disposable lint filter 22. The disposable lint filter 22 separates at least some of the particulate matter 26 from the process air 16. Next, the process air 16 and any remaining particulate matter 26 in the process air 16 is delivered to the vortex lint filter 24. The vortex lint filter 24 further separates at least a portion of the remaining particulate matter 26 from the process air 16. Finally, the process air 16 is expelled from the laundry appliance 10 by the blower 14. In certain aspects of the laundry appliance 10 the filtered process air 16 can be recirculated through the airflow path 18.

Figure 2B:
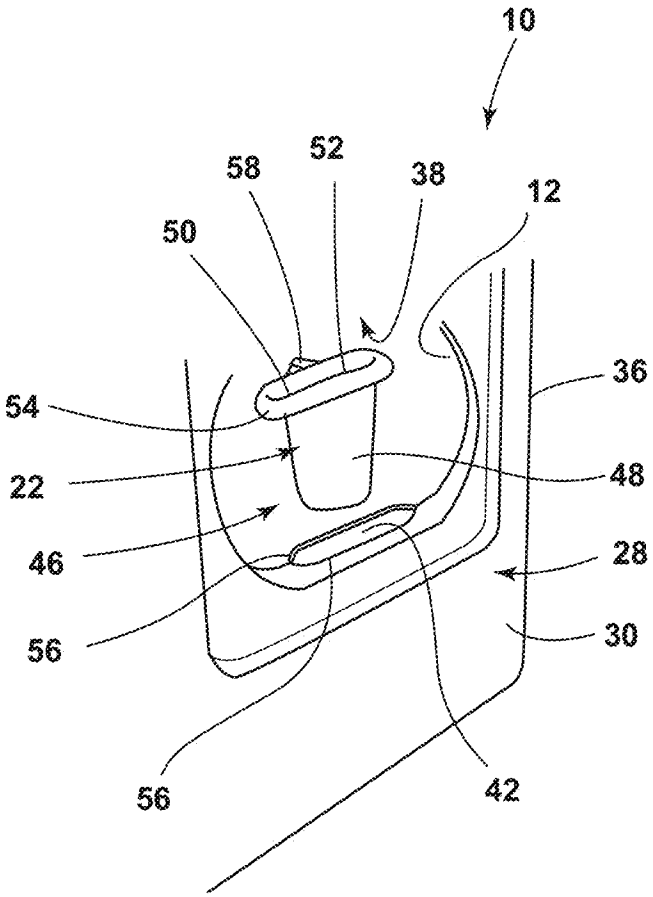
FIG. 2B is a top perspective view of a portion of a laundry appliance illustrating a disposable lint filter in a removed position.

Referring now to FIGS. 1-2B, the laundry appliance 10 includes a cabinet 28. The cabinet 28 includes a front side 30 and a rear side (not shown) that is opposite the front side 30. A top side 32 extends between the front side 30 and the rear side. Left and right sides 34, 36 extend downward from the top side 32 in between the front side 30 and the rear side. In various embodiments, the cabinet 28 of the laundry appliance 10 houses a variety of components of the laundry appliance 10. For example, the drum 12 of the laundry appliance 10 is housed within the cabinet 28. The cabinet 28 of the laundry appliance 10 can be an assembly of a plurality of components.

Figure 2A:
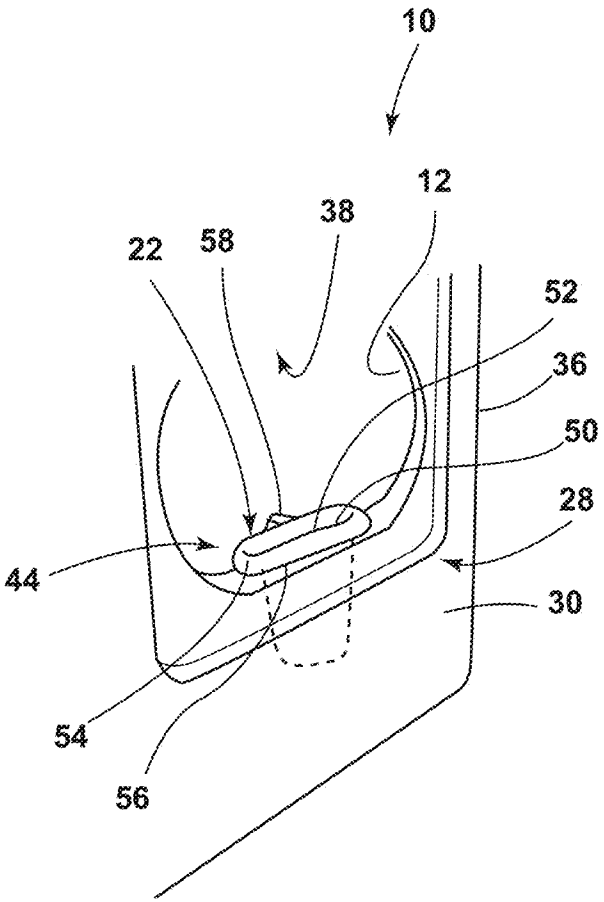
FIG. 2A is a top perspective view of a portion of a laundry appliance illustrating a disposable lint filter in a use position.

The cabinet 28 defines an opening 38 through which the drum 12 housed within the cabinet 28 is accessible. In various embodiments, the front side 30 of the cabinet 28 defines the opening 38, as illustrated in FIGS. 2A and 2B. As illustrated in FIG. 1, the laundry appliance 10 includes a door 40 that is coupled to the cabinet 28 and operable to cover the opening 38 in a closed position and reveal the opening 38 in an open position. It is contemplated that the opening 38 can be defined by at least one of a variety of sides of the cabinet 28. For example, in some embodiments, the top side 32 of the cabinet 28 defines the opening 38 that provides access to the drum 12.

Referring now to FIGS. 2A and 2B, the laundry appliance 10 includes the disposable lint filter 22. The disposable lint filter 22 can be positioned proximate to the front side 30 of the cabinet 28. In various implementations, the disposable lint filter 22 is positioned downward of the opening 38 defined by the front side 30 of the cabinet 28. In the embodiment illustrated in FIGS. 2A and 2B, a housing 42 is defined by the front side 30 of the cabinet 28 below the opening 38. The housing 42 is configured to receive the disposable lint filter 22 therein, in some embodiments, as described further herein.

Referring still to FIGS. 2A and 2B, the disposable lint filter 22 is operable between a use position 44 and a removed position 46. In the use position 44, the disposable lint filter 22 is positioned within the airflow path 18, such that particulate matter 26 is filtered from the process air 16 that is delivered through the disposable lint filter 22. In the removed position 46, the disposable lint filter 22 is removed from the airflow path 18. In the embodiment illustrated in FIGS. 2A and 2B, the disposable lint filter 22 is inserted into the housing 42 below the opening 38 while in the use position 44, as illustrated in FIG. 2A, and is removed from the housing 42 in the removed position 46, as illustrated in FIG. 2B.

Figure 3:
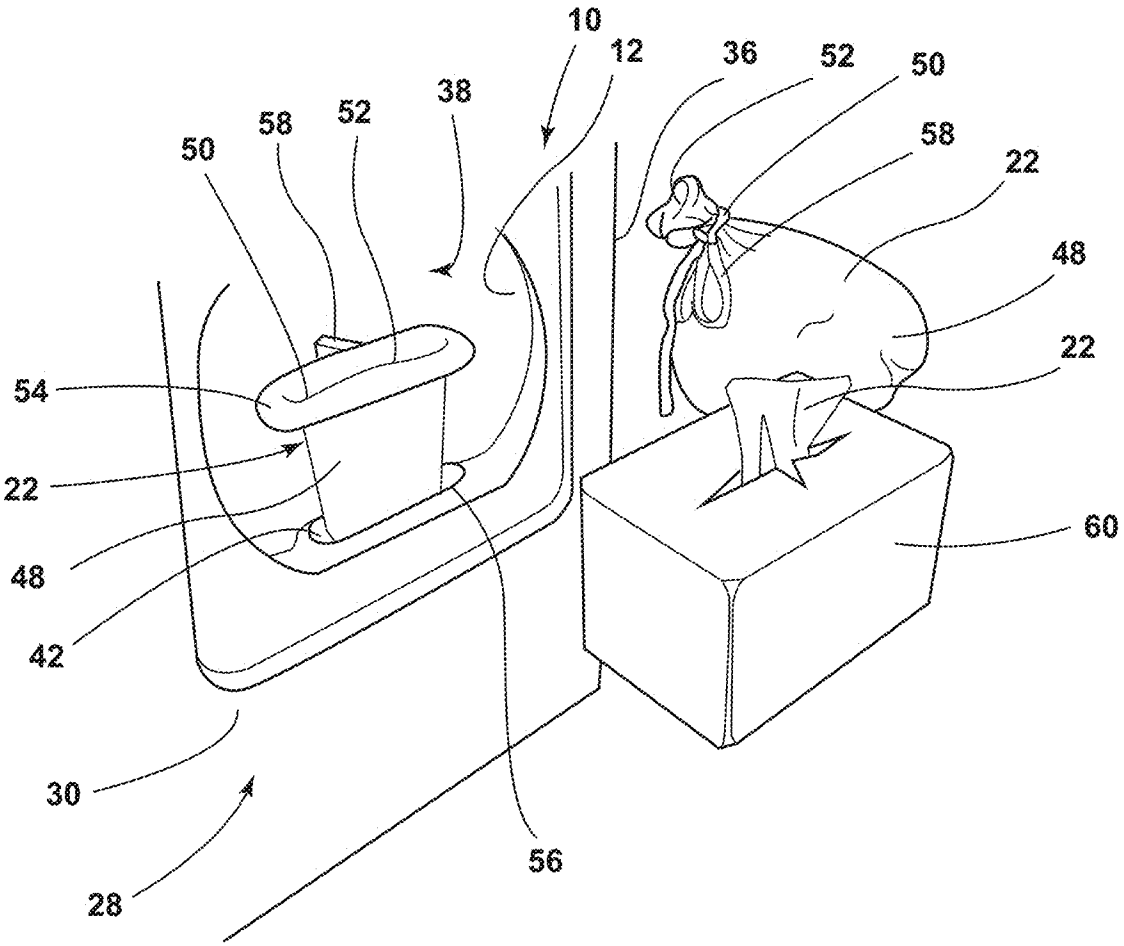
FIG. 3 is a top perspective view of a portion of a laundry appliance that includes a first disposable lint filter in a use position, a second disposable lint filter that contains particulate matter in a removed position, and a disposable lint-filter dispenser.

Referring now to FIGS. 2A-3, in various embodiments, the disposable lint filter 22 generally resembles a pouch. As illustrated in FIG. 2B, the pouch-like disposable lint filter 22 includes an exterior side 48 and an interior side 50 that is accessible via a mouth 52 of the disposable lint filter 22. In the illustrated embodiment, a portion 54 of the disposable lint filter 22 that is proximate to the mouth 52 is folded over. The folded-over portion 54 of the disposable lint filter 22 is proximate to the mouth 52 and can aid in retaining the disposable lint filter 22 in the use position 44. For example, in the embodiment illustrated in FIG. 2A, the folded-over portion 54 generally envelops a rim 56 of the housing 42. The rim 56 secures the disposable lint filter 22 to the housing 42 and provides a rigid structure that ensures that the mouth 52 of the disposable lint filter 22 remains open during use. It is contemplated that the disposable lint filter 22 can be yieldingly retained in the use position 44 via at least one of a variety of retention features (e.g., hook and loop fasteners, hooks, jaws, etc.).

The disposable lint filter 22 can be formed of at least one of a variety of materials that is configured to intercept particulate matter 26 from process air 16 that flows through the at least one material. For example, the disposable lint filter 22 illustrated in FIGS. 2A-3 is a mesh disposable lint filter 22. A variety of malleable porous materials are contemplated (e.g., cloth, fabric, etc.).

Referring still to FIGS. 2A-3, in some embodiments, the disposable lint filter 22 includes a drawstring 58. The drawstring 58 is coupled to the disposable lint filter 22 proximate to the mouth 52 and is operable to narrow the mouth 52 when pulled by a user. As illustrated in FIG. 3, when pulled, the drawstring 58 narrows the mouth 52 of the pouch-like disposable lint filter 22, such that particulate matter 26 disposed within the interior side 50 of the disposable lint filter 22 is contained within the disposable lint filter 22. A variety of types of drawstrings 58 are contemplated. For example, the drawstring 58 may be a loop that extends generally around the mouth 52 within the fabric that forms the disposable lint filter 22 and protrudes outward from a portion of the fabric so that a user can pull the exposed portion of the drawstring 58 to narrow the mouth 52 of the disposable lint filter 22. In another example, the drawstring 58 includes first and second ends that can be pulled and tied together to close off the mouth 52 of the disposable lint filter 22. The drawstring 58 can also be flaps of the material of the disposable lint filter 22 that are used for closing the mouth 52 of the disposable lint filter 22. Embodiments of the disposable lint filter 22 that include a plurality of drawstrings 58 and other types of closure mechanisms are also contemplated.

Referring still to FIG. 3, in some embodiments, a plurality of disposable lint filters 22 can be stored within a dispenser 60. The disposable lint filters 22 within the dispenser 60 can be daisy-chained to one another such that, as one is retrieved from the dispenser 60 by the user, another is moved into a dispensing position.

In operation of an exemplary embodiment of the laundry appliance 10, a user loads laundry into the drum 12 of the laundry appliance 10 and turns the laundry appliance 10 on to dry the laundry. The blower 14 operates to deliver process air 16 into the drum 12. The process air 16 flows out of the drum 12, into the mouth 52 of the disposable lint filter 22, through the interior side 50 and, subsequently, the exterior side 48 of the disposable lint filter 22 before ultimately being expelled from the airflow path 18 by the blower 14 (or recycled through the airflow path 18, where applicable). As the process air 16 flows through the disposable lint filter 22, particulate matter 26 (e.g., lint) is filtered from the process air 16 by the disposable lint filter 22, such that the particulate matter 26 accumulates on the interior side 50 of the disposable lint filter 22. Upon completion of the drying cycle of the laundry appliance 10, the user moves the disposable lint filter 22 from the use position 44, as illustrated in FIG. 2A, to the removed position 46, as illustrated in FIG. 2B. Next, the user pulls the drawstring 58 coupled to the disposable lint filter 22 proximate to the mouth 52 so that the mouth 52 of the disposable lint filter 22 is narrowed, as illustrated in FIG. 3. This narrowing of the mouth 52 aids in preventing particulate matter 26 within the disposable lint filter 22 from escaping during disposal of the disposable lint filter 22. Finally, the user retrieves an unused disposable lint filter 22 from the dispenser 60 and positions the unused disposable lint filter 22 within the housing 42 below the opening 38 defined by the cabinet 28.

According to the various aspects of the device, use of the disposable lint filter 22 aids in capturing a significant portion of particulate matter 26 over the course of a laundry cycle. In addition, because the disposable lint filter 22 encircles the rim 56, process air 16 is directed through the disposable lint filter 22 in such a way that the particulate matter 26 is generally prevented from sticking or otherwise adhering to portions of the housing 42, as can be experienced in conventional drying appliances. In this way, the folded-over portion 54 at least partially seals against the rim 56 of the housing 42 to ensure that all or substantially all of the process air 16 is directed through the disposable lint filter 22 and is not able to circumvent filtration thereof.

Figure 4:
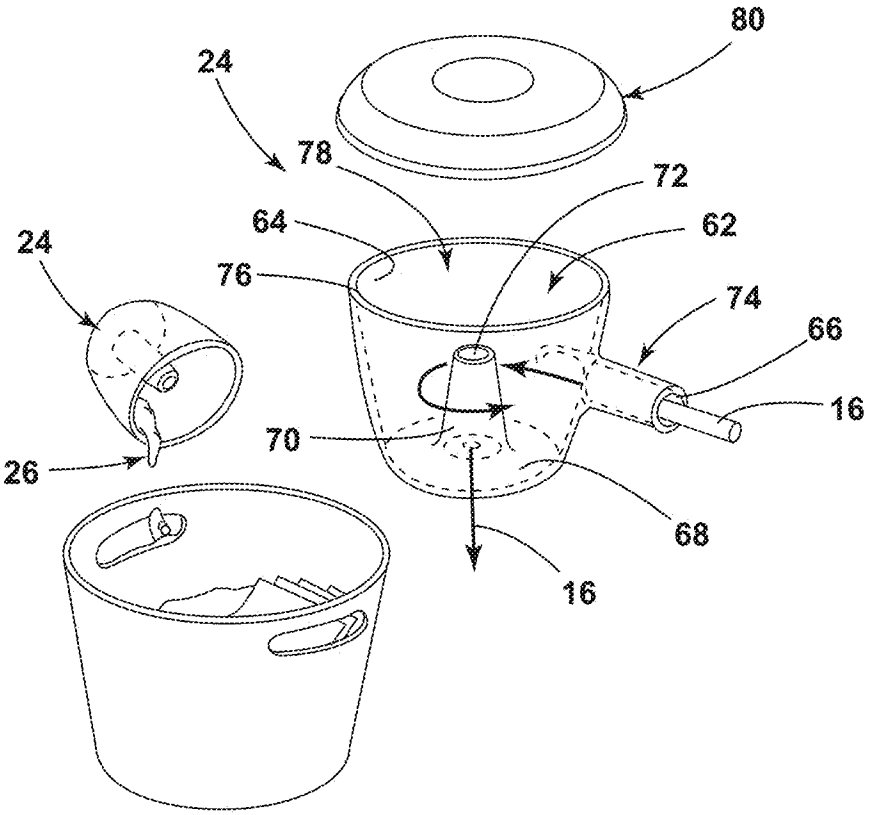
FIG. 4 is a top perspective view of a vortex lint filter for a laundry appliance.

Referring now to FIG. 4, in some embodiments, the laundry appliance 10 includes the vortex lint filter 24. The vortex lint filter 24 includes a receptacle 62. The receptacle 62 includes an outer side wall 64 that defines an inlet 66, a floor 68 that extends inboard from the outer side wall 64, and a tower 70 that extends upward from the floor 68 and defines an outlet 72. In the embodiment illustrated in FIG. 4, a tubular member 74 coupled to the outer side wall 64 defines the inlet 66, and the outlet 72 is defined by an upward-most portion of the tower 70 that is furthest from the floor 68 of the receptacle 62. The outer side wall 64 of the receptacle 62 extends upward from the floor 68 to a lip 76 of the receptacle 62. The lip 76 generally defines a maintenance opening 78 of the receptacle 62. As illustrated in FIG. 4, a lid 80 can be configured to selectively cover the maintenance opening 78 of the receptacle 62. In the illustrated embodiment, the lid 80 is movable relative to the laundry appliance 10 and the vortex lint filter 24. Alternatively, in some embodiments, the lid 80 can be a portion of the laundry appliance 10 that is generally stationary, as illustrated schematically in FIGS. 5 and 6 and described further herein.

In various embodiments, the vortex lint filter 24 is removably coupled to the laundry appliance 10 and operable between a lint-collection position 81, wherein the vortex lint filter 24 is within the airflow path 18 of the laundry appliance 10, and a maintenance position 82, wherein the vortex lint filter 24 is removed from the airflow path 18 of the laundry appliance 10. In some embodiments, wherein the lid 80 is a generally stationary portion of the laundry appliance 10, the lid 80 covers the maintenance opening 78 of the receptacle 62 of the vortex lint filter 24 in the lint-collection position 81 of the vortex lint filter 24, and movement of the receptacle 62 from the lint-collection position 81 to the maintenance position 82 provides access to the maintenance opening 78 of the receptacle 62. As illustrated schematically in FIG. 6, in such embodiments, the vortex lint filter 24 moves relative to the lid 80, which is generally fixedly coupled to a portion of the laundry appliance 10, from the lint-collection position 81 to the maintenance position 82.

In operation of an exemplary embodiment of the laundry appliance 10, the user loads laundry into the drum 12 of the laundry appliance 10 and turns the laundry appliance 10 on to dry the laundry. The blower 14 operates to deliver process air 16 into the drum 12. The process air 16 and captured particulate matter 26 flows out of the drum 12, into the inlet 66 of the vortex lint filter 24, along the outer side wall 64 within the receptacle 62, and, subsequently, out of the outlet 72 defined by the tower 70 that extends upward from the floor 68 of the receptacle 62. The process air 16 is ultimately expelled from the airflow path 18 by the blower 14 (or recycled through the airflow path 18, where applicable). As the process air 16 flows into the inlet 66 and along the outer side wall 64, the captured particulate matter 26 (e.g., lint), which is typically heavier than the process air 16, accumulates within the receptacle 62 on the outer side wall 64 and on the floor 68 below the outlet 72 defined by the tower 70. In this way, the particulate matter 26 is filtered from the process air 16 which exits the vortex lint filter 24 via the outlet 72, as illustrated in FIG. 4. Upon completion of the drying cycle of the laundry appliance 10, the user moves the receptacle 62 from the lint-collection position 81 to the maintenance position 82, which breaks the seal between the receptacle 62 and the lid 80 and provides access to the maintenance opening 78. The user then pours or otherwise extracts the particulate matter 26 from within the receptacle 62 through the maintenance opening 78 before returning the receptacle 62 to the lint-collection position 81.

As described herein, the disposable lint filter 22 and the vortex lint filter 24 can be employed individually or in tandem in the laundry appliance 10, in various embodiments. For example, in the embodiment illustrated in FIG. 5, the disposable lint filter 22 and the vortex lint filter 24 are positioned within the airflow path 18, such that the process air 16 travels first through the disposable lint filter 22 and subsequently through the vortex lint filter 24, or vice versa. A variety of implementations of the disposable lint filter 22 and/or the vortex lint filter 24 are contemplated.

The laundry appliance 10 of the present disclosure can provide a variety of advantages. First, the disposable lint filter 22 having the drawstring 58 can aid the user in containing particulate matter 26 within the pouch-like disposable lint filter 22 during removal of the disposable lint filter 22 from the use position 44. Second, the lid 80 being generally fixedly coupled to the laundry appliance 10, such that movement of the vortex lint filter 24 into the lint-collection position 81 causes the lid 80 to cover and generally seal the maintenance opening 78 of the receptacle 62, streamlines the process of removing particulate matter 26 from the receptacle 62 and returning the receptacle 62 to the operating lint-collection position 81. This streamlined process also diminishes the inadvertent spread of particulate matter 26 around the laundry appliance during disposal of the captured particulate gathered during the drying cycle.

According to one aspect of the present disclosure, a laundry appliance includes a cabinet that defines an opening, a drum accessible via the opening and configured for processing laundry, a blower that conveys process air along an airflow path, and a vortex lint filter coupled to the cabinet and at least selectively disposed within the airflow path. The vortex lint filter has a receptacle that includes an outer side wall that defines an inlet, a floor that extends inboard from the outer side wall, and a tower that extends upward from the floor and defines an outlet. The blower is configured to deliver process air into the receptacle via the inlet, along the outer side wall to create a process air vortex, and out of the receptacle via the outlet, such that particulate matter is separated from the process air and collects within the receptacle.

According to another aspect, the vortex lint filter is removably coupled to the cabinet and operable between a lint-collection position and a maintenance position. In the lint-collection position, the vortex filter is within the airflow path. In the maintenance position, the vortex lint filter is removed from the airflow path.

According to another aspect, the outer side wall of the receptacle extends upward from the floor to a lip of the receptacle that defines a maintenance opening.

According to another aspect, the laundry appliance further includes a lid that selectively covers the maintenance opening defined by the lip of the receptacle.

According to another aspect, the lid is configured to move with the vortex lint filter between the lint-collection position and the maintenance position and is configured to move relative to the vortex lint filter to provide access to the maintenance opening.

According to another aspect, the vortex lint filter moves relative to the cabinet and the lid between the lint-collection position and the maintenance position.

According to another aspect, movement of the vortex lint filter from the maintenance position to the lint-collection position causes the lid to cover the maintenance opening of the receptacle.

According to another aspect, the lid is configured to seal the maintenance opening in the lint-collection position of the vortex lint filter.

According to another aspect of the present disclosure, a laundry appliance includes a cabinet that defines an opening, a drum accessible via the opening and configured for processing laundry, a blower that conveys process air along an airflow path, and a vortex lint filter operable between a lint-collection position and a maintenance position. In the lint-collection position, the vortex lint filter is in the airflow path such that a process air vortex occurs within a receptacle of the vortex lint filter and particulate matter is separated from the process air for collection within the receptacle. In the maintenance position, the vortex lint filter is removed from the airflow path.

According to another aspect, the receptacle of the vortex lint filter includes an outer side wall that includes a lip that defines a maintenance opening.

According to another aspect, the outer side wall of the receptacle defines an inlet and the receptacle further includes a floor that extends inboard from the outer side wall, and a tower that extends upward from the floor and defines an outlet. The blower is configured to deliver process air into the receptacle via the inlet, along the outer side wall to create the process air vortex, and out of the receptacle via the outlet, such that particulate matter is separated from the process air and collects within the receptacle.

According to another aspect, the laundry appliance further includes a lid that selectively covers the maintenance opening defined by the lip of the receptacle.

According to another aspect, the lid is configured to move with the vortex lint filter between the lint-collection position and the maintenance position and is configured to move relative to the vortex lint filter to provide access to the maintenance opening.

According to another aspect, the vortex lint filter moves relative to the cabinet and the lid between the lint-collection position and the maintenance position.

According to another aspect, movement of the vortex lint filter from the maintenance position to the lint-collection position causes the lid to cover the maintenance opening of the receptacle.

According to another aspect, the lid is configured to seal the maintenance opening in the lint-collection position of the vortex lint filter.

According to yet another aspect of the present disclosure, a laundry appliance includes a cabinet that defines an opening, a drum accessible via the opening and configured for processing laundry, a blower that conveys process air along an airflow path, and a disposable lint filter removably coupled to the cabinet and disposed within the airflow path. The disposable lint filter has a mouth and a drawstring configured to be pulled to narrow the mouth. The blower is configured to deliver process air into the mouth and through the disposable lint filter, such that particulate matter is separated from the process air by the disposable lint filter.

According to another aspect, the cabinet includes a front side, and the opening is defined by the front side of the cabinet.

According to another aspect, the cabinet defines a housing below the opening for receiving the disposable lint filter therein.

According to another aspect, the disposable lint filter further includes a folded-over portion that is proximate to the mouth and that generally envelops a rim of the housing.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:

a cabinet that defines an opening;

a drum accessible via the opening and configured for processing laundry;

a blower that conveys process air along an airflow path; and a vortex lint filter coupled to the cabinet and at least selectively disposed within the airflow path, the vortex lint filter having a receptacle that includes an outer side wall that defines an inlet, a floor that extends inboard from the outer side wall, and a tower that extends upward from the floor and defines an outlet, wherein the blower is configured to deliver process air into the receptacle via the inlet, along the outer side wall to create a process air vortex, and out of the receptacle via the outlet, such that particulate matter is separated from the process air and collects within the receptacle, wherein the vortex lint filter is removably coupled to the cabinet and operable between a lint-collection position, wherein the vortex lint filter is within the airflow path, and a maintenance position, wherein the vortex lint filter is removed from the airflow path.

2. The laundry appliance of claim 1, wherein the outer side wall of the receptacle extends upward from the floor to a lip of the receptacle that defines a maintenance opening.

3. The laundry appliance of claim 2, further comprising:

a lid that selectively covers the maintenance opening defined by the lip of the receptacle.

4. The laundry appliance of claim 3, wherein the lid is configured to move with the vortex lint filter between the lint-collection position and the maintenance position and is configured to move relative to the vortex lint filter to provide access to the maintenance opening.

5. The laundry appliance of claim 3, wherein the vortex lint filter moves relative to the cabinet and the lid between the lint-collection position and the maintenance position.

6. The laundry appliance of claim 5, wherein movement of the vortex lint filter from the maintenance position to the lint-collection position causes the lid to cover the maintenance opening of the receptacle.

7. The laundry appliance of claim 6, wherein the lid is configured to seal the maintenance opening in the lint-collection position of the vortex lint filter.

8. The laundry appliance of claim 3, wherein the lid is generally stationary with respect to the cabinet.

9. The laundry appliance of claim 1, wherein the inlet is defined by a tubular member that is coupled to the outer side wall of the receptacle.

10. The laundry appliance of claim 9, wherein the tubular member extends outward from the outer side wall.

11. A laundry appliance, comprising:

a cabinet that defines an opening;

a drum accessible via the opening and configured for processing laundry;

a blower that conveys process air along an airflow path; and a vortex lint filter operable between a lint-collection position, wherein the vortex lint filter is in the airflow path such that a process air vortex occurs within a receptacle of the vortex lint filter and particulate matter is separated from the process air for collection within the receptacle, and a maintenance position, wherein the vortex lint filter is removed from the airflow path.

12. The laundry appliance of claim 11, wherein the receptacle of the vortex lint filter comprises:

an outer side wall that includes a lip that defines a maintenance opening.

13. The laundry appliance of claim 12, wherein the outer side wall of the receptacle defines an inlet and the receptacle further comprises:

a floor that extends inboard from the outer side wall; and a tower that extends upward from the floor and defines an outlet, wherein the blower is configured to deliver process air into the receptacle via the inlet, along the outer side wall to create the process air vortex, and out of the receptacle via the outlet, such that particulate matter is separated from the process air and collects within the receptacle.

14. The laundry appliance of claim 13, wherein the inlet is defined by a tubular member that is coupled to the outer side wall of the receptacle.

15. The laundry appliance of claim 14, wherein the tubular member extends outward from the outer side wall.

16. The laundry appliance of claim 12, further comprising:

a lid that selectively covers the maintenance opening defined by the lip of the receptacle.

17. The laundry appliance of claim 16, wherein the lid is configured to move with the vortex lint filter between the lint-collection position and the maintenance position and is configured to move relative to the vortex lint filter to provide access to the maintenance opening.

18. The laundry appliance of claim 16, wherein the vortex lint filter moves relative to the cabinet and the lid between the lint-collection position and the maintenance position.

19. The laundry appliance of claim 18, wherein movement of the vortex lint filter from the maintenance position to the lint-collection position causes the lid to cover the maintenance opening of the receptacle.

20. The laundry appliance of claim 19, wherein the lid is configured to seal the maintenance opening in the lint-collection position of the vortex lint filter.

* * * * *